US009901124B2

(12) United States Patent
James

(10) Patent No.: US 9,901,124 B2
(45) Date of Patent: Feb. 27, 2018

(54) CONTOURED BUTTOCKS ENHANCING AND TUMMY SLIMMING HOSIERY AND FOUNDATION GARMENT

(71) Applicant: Winfield Gilbert James, Ellenwood, GA (US)

(72) Inventor: Winfield Gilbert James, Ellenwood, GA (US)

( * ) Notice: Subject to any disclaimer, the term of this patent is extended or adjusted under 35 U.S.C. 154(b) by 0 days.

(21) Appl. No.: 14/586,870

(22) Filed: Dec. 30, 2014

(65) Prior Publication Data

US 2015/0208733 A1 Jul. 30, 2015

Related U.S. Application Data

(60) Provisional application No. 61/932,588, filed on Jan. 28, 2014.

(51) Int. Cl.

| | |
|---|---|
| ***A41B 11/14*** | (2006.01) |
| ***A41B 9/04*** | (2006.01) |
| ***A41C 1/08*** | (2006.01) |

(52) U.S. Cl.

CPC ..... *A41B 11/14* (2013.01); *A41B 9/04* (2013.01); *A41C 1/08* (2013.01); *A41B 2400/38* (2013.01)

(58) Field of Classification Search

CPC .. A41B 9/00; A41B 11/14; A41B 9/08; D04B 1/22; D04B 1/343; D04B 1/24; D04B 1/26; D04B 11/34; D04B 11/32; D04B 21/20; D04B 7/30; D04B 9/42; D04B 9/46; D04B 9/54

USPC ..... 2/409, 69, 67; 66/171, 177, 169; 450/94–106, 112

See application file for complete search history.

(56) References Cited

U.S. PATENT DOCUMENTS

| | | | | |
|---|---|---|---|---|
| 3,678,514 A * | 7/1972 | Safrit | A41B 9/08 2/212 |
| 4,059,973 A * | 11/1977 | Gresillon | D04B 1/243 66/177 |
| 2010/0107316 A1* | 5/2010 | Rad | A41B 11/14 2/409 |
| 2010/0235970 A1* | 9/2010 | Rad | A41B 11/14 2/409 |

* cited by examiner

*Primary Examiner* — Gloria Hale

(57) ABSTRACT

The invention discloses a contoured, buttocks enhancing hosiery foundation garment having permanent inner structures of a buttocks enhancing system comprising an open-cell foam pad or silicone gel casing in its rear panel portion fabricated and housed in two-ply fabric portions of stretchable yarn, with a tummy slimming function which eliminates the need for additional shaping devices or girdle type foundation garment. The buttocks enhancing contoured and tapered system is laminated in the two-ply fabric of which the panty portion of the garment is fabricated. The tapered edges of the buttocks enhancing system allows for a seamless and transition to the single-ply leg portions. The contoured buttocks enhancing and tummy smoothing foundation garment allows for great flexibility and comfort regardless of the movements of the wearer due to the structure of the panty portion with the marquise diamond shaped two-way stretchable and oversized gusset system.

19 Claims, 5 Drawing Sheets

19
10c
10a
11
10
11b
f2
11a
18
11d
11d
10i
10h
f1
00
11h
f1

11d 19
10c
10b
10
18
00
f2
f1
11
11h
10h
10i

CONTOURED BUTTOCKS ENHANCING AND TUMMY SLIMMING HOSIERY AND FOUNDATION GARMENT

FIELD OF THE INVENTION

The present invention relates to lower-body hosiery and foundation garments with a utility purpose for providing contoured buttocks shape enhancement and slimming tummy control when worn under the outer clothing.

BACKGROUND OF THE INVENTION

The process to improve the appearance of the lower portion of the female body began with the invention of the girdle. The girdle, however, is primarily constructed from materials which confine, constrain and restrict the wearer, inhibiting movement and causing great discomfort.

The desire to attain a perfect physique, in particular, a more shapely and contoured buttocks is heightened by the constant barrage of such images by mass media marketing in the fashion, beauty and cosmetic surgery industries. Approaching the quest for the appearance of a perfect figure, individuals engage in stringent diet and exercise routines. Additionally, many persons, predominantly women, regularly resort to the option of cosmetic surgery in order to achieve this end, often times at great financial costs and at significant medical risks. These procedures many times fail and lack the desired results.

The fashion and apparel industry have produced a variety of garments, including panties, girdles and hosiery claiming to slim the tummy area and lift or exaggerate the buttocks. These garments attempt to provide visible improvement of the wearer's outward appearance. However, none of these garments, either foundation or hosiery type provide a singular unitary undergarment system which incorporates both tummy slimming control and a formed, contoured buttocks to support and enhance the lower torso area of the female physique.

Specifically, the control top panty hose and other similar type undergarments, including above and below the knees versions, which are designed to slim and smooth the abdomen and gluteal areas of the female anatomy rarely accomplish any noticeable enhancement or appreciable difference. Rather the referenced garments and hosiery constrict and confine the wearer and often times produces a uni-butt and muffin top phenomenon. This is due to existing one-size-fits-all gusset systems both in terms of size of the gusset's actual construction and limitation of only a vertical stretch or elasticity of same. Further, current gussets do not fully expand in all directions or allow the natural and full expansion to accommodate for varying dimensions of an individual wearer's buttocks. This limitation is especially evident with movements of the lower torso, such as walking and bending.

The more recent introduction of a variety of insertable pads, garments to accept the pads, padded panties, garments with built in girdles and foundations; marketed and directed towards improving the shape and visually enhancing the buttocks and hips, as well as flattening the abdomen of the wearer have proliferated the market. These garments, most typically panties, provide the wearer with an unnatural appearance and often times, by their very nature, bind, confine and restrict the wearer with no natural accommodation or natural separation of the individual buttocks cheeks. Further, the individual foam pads or silicone gels are very visible when worn under the wearer's clothing. This results in two distinctly separate and unsymmetrical buttocks cheeks which protrude in an abnormal "bubble-butt" appearance.

In general, existing garments, in particular undergarments and hosiery, do little more than constrain, redistribute and reposition the wearer's underlying hips, buttocks, tummy and surrounding superfluous fat. Moreover, these garments when made from girdle duty materials, particularly garments with multiple layers of such heavy duty fabric simply squeeze, truss and thrust the buttocks and hips into conformity, while constricting the wearer's abdomen. These garments are therefore inadequate. In addition to the uni-butt phenomenon, when the abdomen of the wearer is constricted, significant discomfort to the wearer is experienced. The wearer's belly fat at the transition area from undergarment to bare flesh often protrudes upwards and results in the dreaded muffin-top appearance.

Further, in instances where separate undergarments are worn under exterior clothing for shape enhancement; as with currently available padded panties, or similar type undergarments with pockets for inserting two separate pads, the wearer either experiences the uni-butt phenomenon; or uneven shifting and sagging of the individual buttocks cheeks with movement and usage. Both of these ill desired results are readily visible through the outer wear. The end result is an unnatural and unattractive appearance which is uncomfortable and cumbersome to the wearer at best.

Frankly, current undergarments and hosiery fail to provide a structured, unitary garment whose panty portion creates a contoured, shaped form system which tapers, accommodates and enhances the wearer's individual figure in an unrestricted, natural and comfortable manner.

SUMMARY OF THE INVENTION

The present invention remedies the shortcomings noted in prior art by providing a unitary shape enhancing foundation garment, including the pantyhose type undergarment garment comprising of a contoured, shaped open cell foam or silicone gel formed pad into the singular foundation garment or hosiery type undergarment to provide the wearer with a naturalistic lifting, contouring and shaping of the lower torso region without constriction, confinement or other stated drawbacks noted in prior art.

In accordance with the preferred embodiment of the present invention the foundation garment or hosiery is formed from two continuously woven elastic or Spandex cylinder type one-ply fabric tubes, centrally joined at the top panty portion and coupled with a specifically shaped enhanced contoured formed panel to effectively create a unitary contoured buttocks shape enhancement foundation garment or pantyhose, with tummy control that is not readily visible or detectable when worn under the outer clothing. The composition of the weave of elastic or Spandex fabric can vary to provide for a sheer or more opaque hosiery or foundation garment and finished at a point above or below the knees or ankles and with open or closed toe portions.

In accordance with the preferred embodiment of the present invention, the specifically shaped, enhanced and contoured formed panel is permanently fused into the undergarment through a lamination process so as to encase the formed panel between the two-ply panty portion posterior of the foundation garment or pantyhose. Another aspect of the present invention allows for graded fullness of the posterior formed pad through the provision of varied thicknesses and weight to accommodate wearers of diverse physique and sizes.

Further, the panty portion which terminates at the beginning upper leg portions is formed when the joined continuously woven one-ply fabric is circumferentially folded at a more tightly knit and compressed strategic portion to form the waistband of the panty portion of the foundation garment or hosiery and encases the laminated inventive formed pad at the rear of the undergarment, and where it is more tightly woven and compressive to provide the two-ply frontal panel sufficient to create a gentle control and a slimming effect. This aspect of the present invention provides for gentle slimming control of the tummy area while avoiding the "muffin-top" effect from over compression and without compromise of the instant posterior enhancement device when the foundation garment or hosiery is worn.

In accordance with the preferred embodiment of the present invention, the specifically shaped, enhanced and contoured formed panel is fabricated with an inner concave and an outer convex side and a centered, tapered inverted "V" opening which emanates from the top portion of the natural buttocks separation and is contoured and tapered so as to expand and accommodate the natural buttocks shape and cheeks of the wearer individually, allowing for natural freedom of movement without the uni-butt effect.

Another aspect of the instant invention is the structured, elongated, multi directional stretchable marquise diamond shaped gusset system which is sewn, woven or otherwise integrated in the panty portion of the undergarment beginning from the uppermost end of the "V" centered opening at the posterior and extending to the anterior crotch area of the panty portion of the undergarment. Specifically, the specially designed gusset system consisting of either double layer or two-ply expandable and retractable fabric is diamond shaped and highly elastic and stretchable so as to accentuate and simulate the natural separation of the individual right and left cheeks of the buttocks, and extends downward and outward from the top of the inverted "V" towards the bottom of the open-cell foam or silicone gel panel at the central crotch area and terminating at the lower anterior region of the panty portion of the foundation garment.

Further, in accordance with a preferred embodiment of the present invention, the leg portions are woven in a manner which provides for a seamless transition to the top portion of the hosiery foundation garment, with the formation of the panty portion of the foundation garment. Within the panty portion is the formation of the double layered tummy slimming front panel and encasement of the open cell or silicone gel formed pad in the rear, which is blended and seamlessly integrated at the bottom portion of the panty segment to the single layer sheer or opaque hosiery and undergarment; which is finished above or below the wearer's knees, ankles or closed toes. This seamless transition and integration prevents any visible detection of the encased laminated shape enhancing pad hosiery or undergarment.

Thus, in accordance with the preferred embodiment of the present invention, the instant invention remedies a multiplicity of pitfalls and shortcomings of prior shape-enhancing formed buttocks enhancing foundation garments, padded panties and hosiery of prior art which in addition to the noted disadvantages fall short of achieving a unitary foundation garment or hosiery which accentuates and shapes the buttocks while simultaneously slimming and controlling the abdominal area of the wearer. The foundation garment and hosiery of the instant invention in its purest preferred embodiments provides a beautiful contoured buttocks enhancing and tummy slimming garment without the provision of undesirable outcomes such as unsightly bubble or uni-butt, or muffin top to the wearer. Further, with the collective embodiments of the instant invention fully integrated into a singular undergarment of hosiery, the preferred embodiment of the present invention, the specifically formed shape enhancement pad is undetectable and not visible in any manner when the wearer of the foundation garment or hosiery is viewed from any referenced point and regardless of any activity or position the wearer is engaged in. In doing so, the foundation garment or hosiery of the instant invention provides for a suave appearance when worn without any evidence or revelation of the underlying enhancement supplied by the present invention.

BRIEF DESCRIPTION OF THE DRAWINGS

The descriptions that follow are of the preferred embodiments of the instant invention which will be better understood when reviewed in conjunction with the associated figures and drawings.

The drawings are included for purposes of delineating key embodiments of the present invention and do not in any manner and form place limitations to what is claimed.

DETAILED DESCRIPTION OF THE INVENTION

The present invention will now be described and discussed in a more comprehensive manner with references to the accompanying schematic and descriptive drawings, as the preferred embodiments of the present invention are illustrated. FIGS. 1 through 12 and the narrative that follows details the exemplary embodiments and the construction of the present invention employing a consistent numbering pattern which references specific and similar elements throughout the schematic illustrations.

It must be understood that, in addition to the specific illustrations herein, the preferred embodiments may be incorporated in many different forms, and with various elastically woven yarn and fabrics, including Spandex, LYCRA and other blends of polyester and nylon. As such, the invention presented here should not be construed as limited to the schematic illustrations set forth herein. Fundamentally, these embodiments are provided in order that this disclosure will be comprehensive and thorough with full conveyance of the scope of the invention to people skilled in the art and trade of foundation garments and general clothing manufacturing.

The hosiery and foundation garment, identified as 10 of the present invention, in the schematic illustrations, and the materials and process for construction of the foundation garment and hosiery in accordance with the preferred embodiment of the invention are schematically illustrated on drawing sheets 1 through 5. FIGS. 1 through 12 illustrate a preferred method for fabricating shape enhancing hosiery and hosiery type foundation undergarments in accordance with the instant invention.

Figure 1:
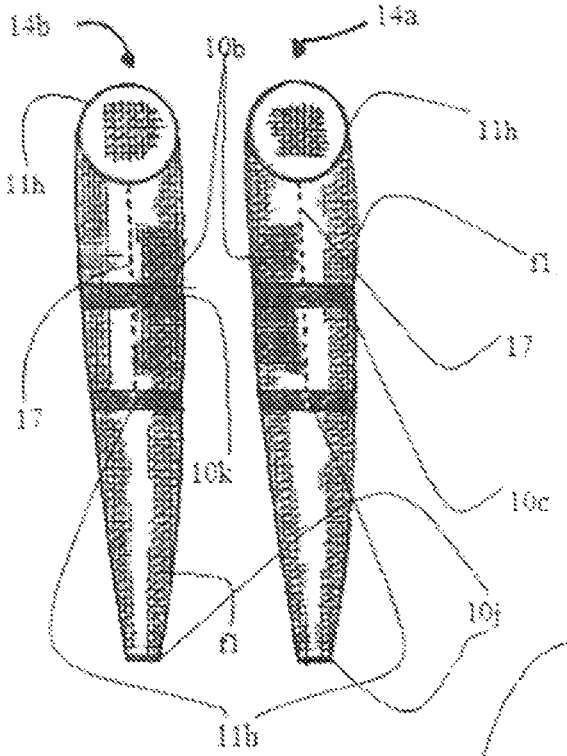
FIG. 1 is a perspective view, which depicts a pair of specifically woven elongated single-ply fabric tubes used to fabricate the legs and corresponding halves of the two-ply panty portion of a hosiery type undergarment, in accordance with a preferred embodiment of the present invention.

The foundation garment or hosiery 10, generally formed of elastically woven yarn and fabrics, including Spandex, LYCRA or other suitable fabrics, is continuously woven in a cylindrical, elongated single-ply manner, and ranging from a sheer to a denser and varied stretchable, compressible weave, particularly at the upper end of the specifically elongated portions of 14*a* and 14*b* as depicted in FIG. 1; and forms the right leg portion 10*h* and the left leg portion 10*i*; and when longitudinally slit in a measured manner along a slit line 17. Of significance, the strategic weaving of the density, compressibility and stretch recovery of 14*a* and 14*b*, and consequently 11 and 10 in areas where the upper thighs, abdomen, and hips of the wearer are encased, allows for sufficient shaping and contouring of a wide range of body types when the significant embodiment of the instant invention, a contoured open-cell foam or silicone gel formed pad 11*d* is integrated within the folded rear panel 10*a* of the panty portion 11 of the undergarment 10. Essentially, FIGS. 1 through 12 illustrate a preferred method for fabricating a hosiery undergarment in accordance with the instant invention.

As shown in FIG. 1 the fabrication process begins with a pair of single-ply fabric tubes 14*a* and 14*b* which are formed through the continuous weaving of elastically woven yarn in a circular seamless manner to create the specifically elongated tubes with greater compression at specific points along the upper end of each specifically elongated tube which is described herein. Further, in accordance with preferred embodiments of invention 10, the legs 10*i* and 10*h*, which again are seamless and woven with a heavier weave at specific points along the upper end of each specifically elongated tube to form the panty portion 11 as detailed throughout, may extend downward to a length above the knees, below the knees, or extend to enclose the toes of the wearer within multiple versions of the present invention 10.

Figure 2:
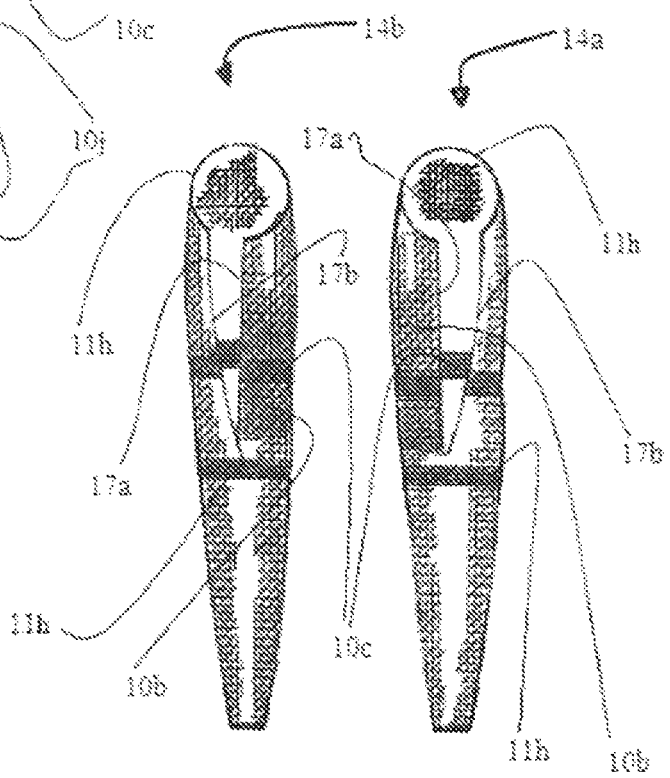
FIG. 2 is a perspective view depicting the fabric tubes shown in FIG. 1 slit longitudinally to a measured length for formation of the two-ply panty portion of the hosiery type undergarment in accordance with a preferred embodiment of the present invention.

As depicted in FIG. 2 the specifically elongated upper portion of the tubes are slit along line 17 to a length generally twice that of a slit in conventional hosiery, with each strategically woven single-ply fabric tube 14*a* and 14*b*, now each having a front edge 17*a* and a rear edge 17*b*. The two tubes 14*a* and 14*b* are then joined together at the front edges 17*a* and at the rear edges 17*b* to form the front sewing seam 18 and the rear sewing seam 19, and thereby forming an elongated single tube in the upper unified regions of 10*a* and 10*b* which ultimately forms the panty portion 11 of the undergarment 10.

Figure 3:
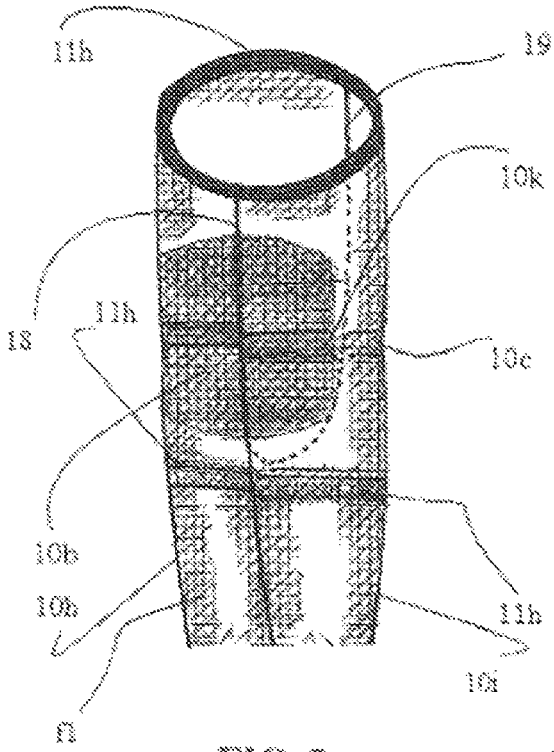
FIG. 3 is a frontal perspective view, showing the two elongated slit fabric tubes sewn together to form the panty and housing component of the hosiery undergarment, as a preferred embodiment of the invention.
Figure 5:
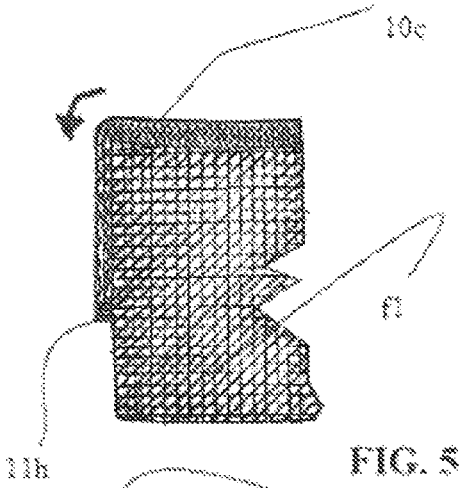
FIG. 5 is a sectional view of the fabric fold of the joined elongated tubes at the waistband portion which forms the two-ply panty portion of the foundation garment and housing of the integrated buttocks enhancing formed pad, in accordance with a preferred embodiment of the invention.
Figure 4:
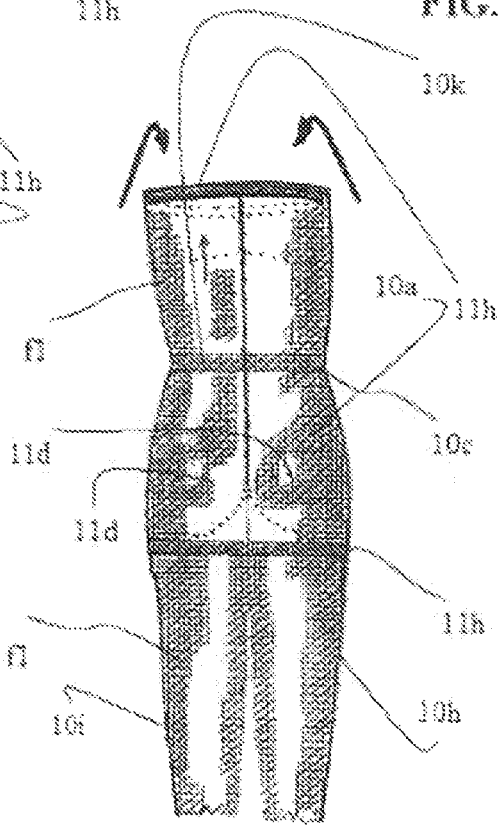
FIG. 4 is a posterior perspective view, showing the two sewn together elongated tubes and placement of the buttocks enhancing open-cell or silicone gel formed pad in the posterior section of the hosiery type undergarment, as a preferred embodiment of the present invention.

Depicted in FIGS. 3 and 4 are the anterior and posterior elongated top portions of 10*a* and 10*b* with the varied compressible weaved fabric of the centrally joined slit tubes 14*a* and 14*b* which forms a central component of the invention, namely the panty portion 11, to house the contoured shaped enhancing formed pad 11*d*. This utility is achieved when the anterior and posterior elongated top portions of 10*a* and 10*b* are circumferentially folded inward, as indicated by the arrows, at the waist portion fold line 10*k* and forms the waistband 10*c* and is specifically detailed in a close-up view in FIG. 5. As detailed, when 10*a* is folded at 10*k*, the two-ply or double layered panty housing portion 11 is formed to posteriorly encase the contoured shape enhancing formed pad 11*d*; when 10*b* is folded, again at 10*k*, the two-ply or double layered anterior stretchable and compressible weaved tummy control panel of panty portion 11 is formed, with the fabrication process being further detailed in FIGS. 7 through 12.

Figures 6, 7, 8:
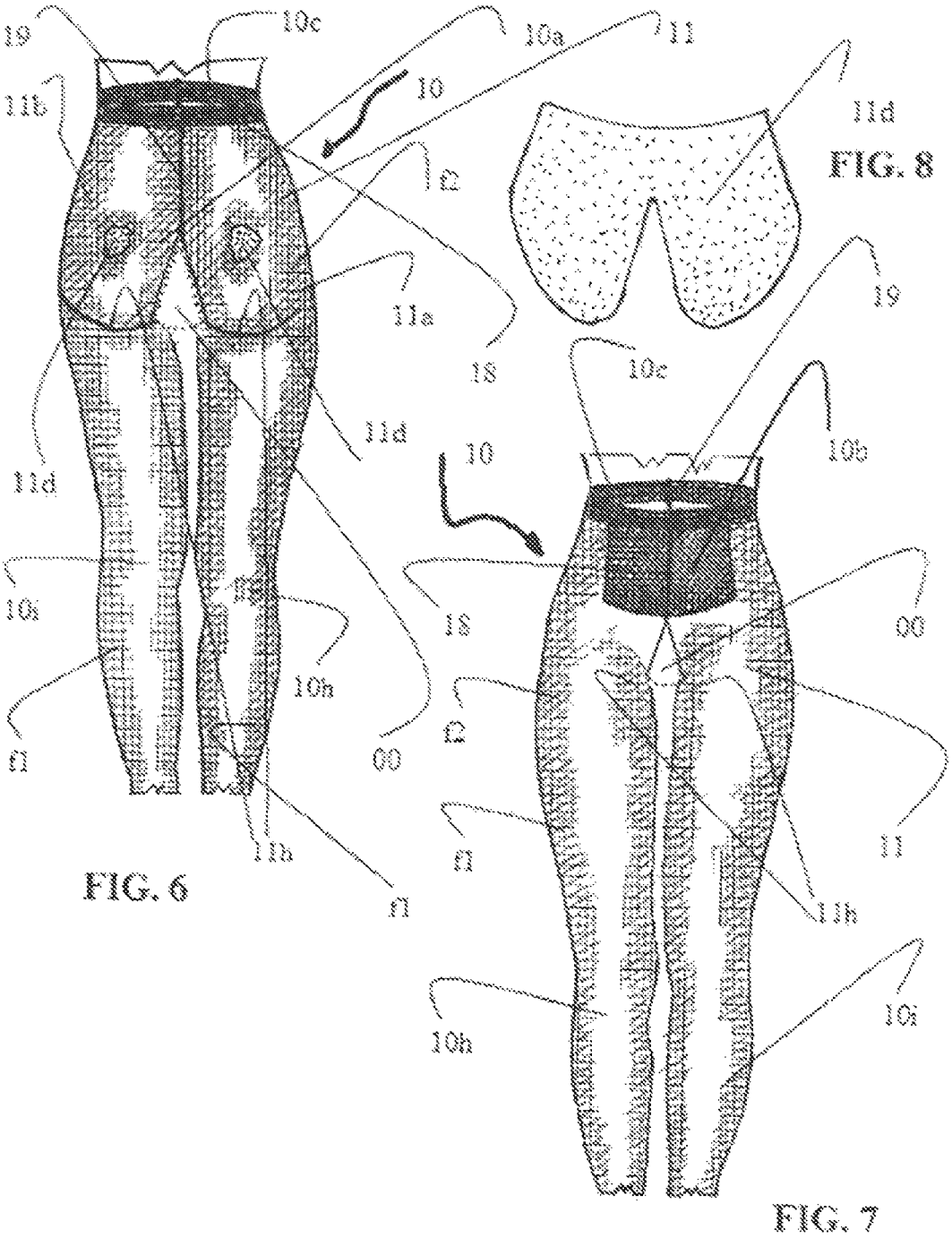
FIG. 6 is a perspective schematic illustration, showing a rear view of the hosiery undergarment when worn, with an integrated shape enhancing formed pad in place within the folded two-ply panty portion, in accordance with a preferred embodiment of the instant invention.
FIG. 7 is a perspective schematic illustration of frontal view of the undergarment invention with the folded two-ply panty portion depicting the specifically woven tummy control panel as a preferred embodiment of the present invention.
FIG. 8 is a detailed flat schematic illustration of the buttocks enhancing open-cell or silicone gel formed pad in accordance with the preferred embodiment of the instant invention.

Depicted in FIG. 6 is a preferred embodiment of the invention, the strategically designed contoured, convex and concave shaped, buttocks enhancing open-cell or silicone gel formed pad 11*d*, which is shown in a flat view, prior to integration into the posterior of the folded 10*a*, namely the rear of 11. The contoured buttocks enhancing formed pad 11*d*, positioned with the concave side facing inward and the convex side facing outward is affixed, woven and otherwise laminated within the posterior section of 11 and shown in a cut-away or peek-through view in FIG. 7. This utility created, as previously described, includes the strategic sandwiching of 11*d* within the posterior of 11 following the folding of the joined elongated tubes 10*h* and 10*i* at 10*k*, to form the two-ply panty portion 11, and importantly the rear panel 10*a*, the posterior of the panty portion 11 of invention 10. Similarly, FIG. 8 provides a direct frontal view of the invention 10, with a prominent display of the two-ply or double layered tummy slimming control panel of the abdominal area which is formed when the front panel 10*b* is folded at 10*k*.

Figure 9:
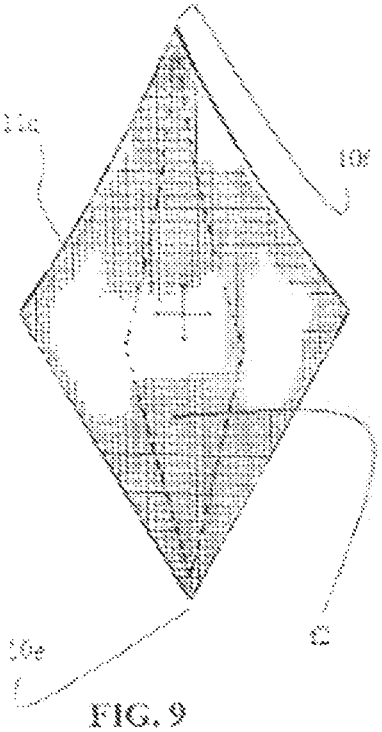
FIG. 9 is a detailed flat view of the special utility designed oversized diamond shaped two-way stretchable two-ply gusset panel in accordance with a preferred embodiment of the present invention.

Of significance and shown in FIGS. 6, 7 and 8, is the inverted "V" opening 00. This utility strategically provides for incorporation of the marquise diamond shape oversize two-ply gusset when the 10*a* and 10*b* are folded circumferentially to form 11. The inverted "V" opening of the formed shaped buttocks enhancing pad 11*d* is fully affixed, aligned and integrated within the folded posterior of 11 by cutting away a specific measured portion of the crotch area of 11 along the inverted "V' 00 of 11*d* for placement of the specially oversized marquise diamond shape two-ply gusset panel 11*c*, as illustrated in FIG. 9. Specifically, FIG. 9 provides a schematic illustration of the specially designed diamond shape oversized two-ply gusset panel 11*c* which is comprised of highly multi-directional stretchable and stretch recoverable material.

To further detail the preferred embodiments of the invention shown in FIGS. 7 and 8, referring back to Drawing Sheet 2, identifies 11*h* as the upper edge of the elongated front and rear panels, and subsequently when folded at 10*k* creates the lower inner edge of the two-ply panty portion 11. This segment, 11*h*, of the panty portion 11, is blended and seamlessly integrated at the bottom edge of 11 to the single layer sheer or opaque hosiery undergarment following full integration of 11*d* and 11*c* for integral completion of 11 of the invention 10, with a transition back to the single-ply leg portions 10*h* and 10*i* at the lower edge 11*h* of the panty portion 11.

Figure 10:
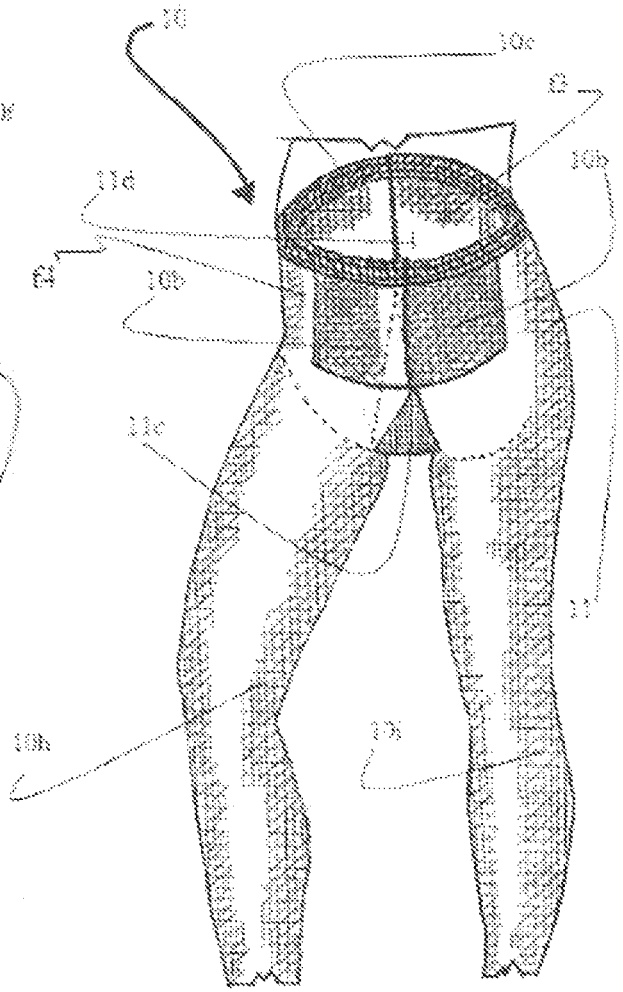
FIG. 10 is a perspective view, generally from the front, showing the hosiery type undergarment on a phantom model with the key components of the preferred embodiments of the invention.

FIG. 10 is a schematic illustration of the more densely weaved front panel 10*b* which creates the tummy control utility of 11. Also schematically illustrated in FIG. 10 is a predominant frontal perspective view of the marquise diamond shape gusset panel 11*c*, when fully integrated in the shape enhancing undergarment 10.

To emphasize the novelty of the invention, the oversize separately formed diamond shape two-ply multi-directional stretchable gusset panel 11*c* when sewn into the buttocks enhancing panty portion 11 and affixed to the inverted "V" opening of the open-cell or silicone gel pad at the posterior of the panty portion and at the anterior opening of the panty portion above the two tubes of the leg portions to accept placement of the marquise diamond shape expandable gusset panel system presents the centrally preferred embodiment of the invention 10.

Figure 11:
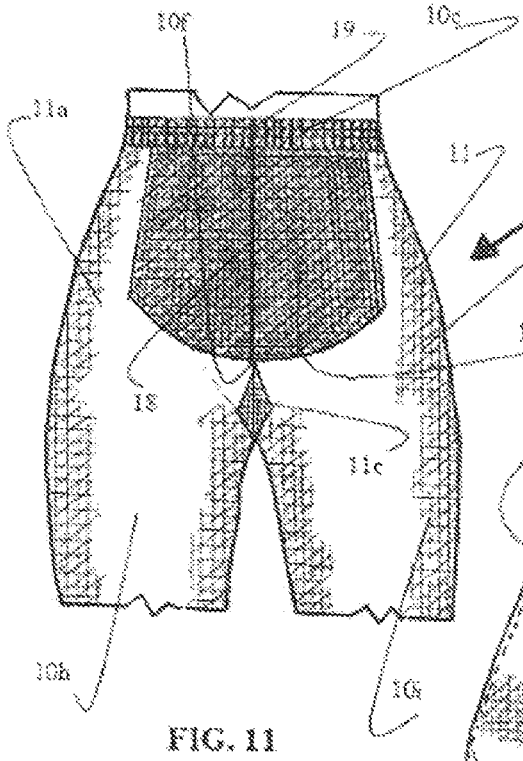
FIG. 11 is an illustrative view, essentially from a frontal schematic perspective, showing the hosiery undergarment on a phantom model, in accordance with a preferred embodiment of the invention.
Figure 12:
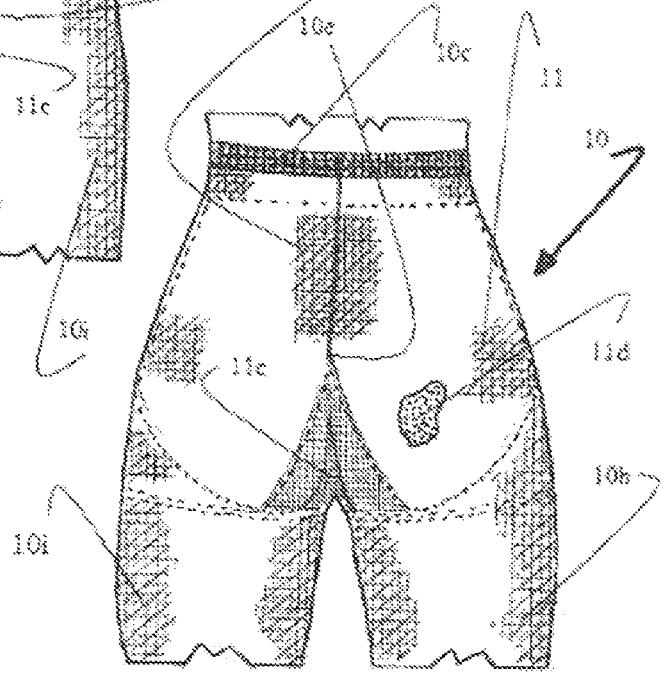
FIG. 12 is a schematic view of the invention on a phantom model, basically shown from a rear perspective view.

FIGS. 11 and 12 are perspective views of the rear and the front of the foundation garment, or hosiery, when worn in accordance with the preferred embodiments of the present invention 10, depicting the panty portion 11 including a illustrative representation of the placement of the specially formed diamond shape two-ply, highly elastic, multi-directional stretchable gusset panel 11*e* woven or other wise affixed at the inverted "V" opening of the formed pad 11*d* and extending to the frontal crotch area 11*c*, in accordance with the preferred embodiments of the invention 10. Specifically, FIG. 12 shows the back portion of 11*e*, and FIG. 11 shows the frontal perspective view of the gusset 11*c* and the front panel 10*b*. Of note, "foundation garment", "undergarment", "hosiery", "garment" and "hosiery undergarment" are used interchangeably throughout the delineation and description of the preferred embodiments of the present invention.

It is further emphasized at this juncture that, in accordance with the preferred embodiment of the invention, the single ply fabric tubes 14*a* and 14*b*, which are seamless, as aforementioned, are continuously woven to a length that is about twice the length in the upper region of the fabric tubes as compared to a similar measured segment of a conventional pantyhose or hosiery undergarment tube, with a 2-inch heavier knitted portion 10*c* as depicted in all relevant schematic illustrations. Of note, the fold line 10*k* is also along the 10*c* plane, as shown in FIG. 1. To further delineate, this fold line 10*k* is located at a point that would be the upper end point of the fabric tubes in prior art, that is, the typical conventional pantyhose type garment panty portion top edge. This heavier woven portion, comprising of spandex yarn or similar materials will ultimately accept a midpoint at fold line 10*k* to ultimately transform the specifically elongated fabric tubes into the panty portion 11 of the invention 10. The waistband 10*c* is folded in conjunction with the process in which 11*d* is integrated by weaving or lamination into 11 to complete in the fabrication of the undergarment 10. That is, the waistband portion 10*c* is finally secured in the undergarment 10 when the fabric fold sandwiches and laminates the tapered contoured buttocks enhancing open-cell foam or silicone gel casing 11*d* within its two-ply fabric transition 12 to form the panty portion 11 of the undergarment 10. The lower end of the inner folded fabric, after the integration process, which is identified as f3 in FIG. 10, lie against the inner surface of the outer ply, identified as f4 at this point in the panty portion 11 as it does throughout the front panel 10*b* and is woven to the outer ply f4 at the crotch and bottom edge of the enhancing and control areas, and at the lower edge of the panty portion 11, which is identified as 11*h* in the schematic illustrations. As such, the inner side of the panty portion housing the contoured buttocks enhancing concave (inner side) and convex (outer side) open-cell or silicone gel pad is identified as f3 and the outer fabric of the laminated area is identified as f4 within the framework of the other referenced points of the invention 10.

As aforementioned, in addition to being comprised of two fabric plies, the panty portion 11 of the foundation garment 10, when viewed from the wearer's perspective, are joined together along a front seam 18 and a rear structured seam 19 to supplement flexibility and secure the encased contoured buttocks enhancing panel system at its posterior. Further, the panty half 11*a* is a continuous extension of the right leg portion 10*h* and the left panty half 11*b* is a continuous extension of the left leg portion 10*i*, which results in an undergarment comprising of a two-ply panty portion and single ply legs portions. Of note, as a result of the novel elongated measured length of the segment of the fabric tubes that transition the single ply legs portions to the two-ply panty portion at the fold point 10*k*, the slit in the fabric tubes 14*a* and 14*b* are approximately twice the length of the equivalent slit in the fabric tubes of prior art or conventional pantyhose garments, with this transition to a two-ply fabric portion yielding improved control of the abdominal area without any yarn modification and without compromising the buttocks enhancing rear panel system.

In another preferred embodiment of the invention, the folded over lower edge of the inner ply f3, of the two-ply panty portion can remain free-floating, with only an attachment to the inverted "V" opening of the buttocks enhancing panel (see FIG. 8) and the diamond shape gusset panel 11*c*.

In still another preferred embodiment of the invention, the single-ply fabric tubes may be manufactured in such a manner that they transition into a two-ply fabric at the point along the tube where the leg portions will transition to the panty portion of the finished product, to allow for the insertion of the buttocks enhancing panel through the space between the two plies of the not yet joined waist portion of the garment components, which in then followed by lamination of the panel within the inner and outer plies of the panty portion and securing of the waistband portion with a flat stitch, followed by completion of the other embodiments of the invention 10.

As a preferred embodiment of the invention, the hosiery undergarment is made predominantly of Spandex yarn of between 50 and 70 denier or with nylon and other stretchable synthetic fabrics. The marquise diamond shape highly elastic and stretchable gusset system 11*c* can be comprised of cotton and synthetic fabric with improved breathability as depicted in FIG. 9. As previously described, the preferred fabric used for gusset fabrication is a two-ply fabric, f2, that stretches equally in all directions and is highly elastic, which means it consistently returns to its relaxed state, insuring total comfort and flexibility for the wearer. In this preferred embodiment of the panty portion 11 the folded over single ply fabric provides for slimming and improved control of the abdominal region of the wearer as it transitions to the two-ply garment portion at the waistband portion 10*c* and terminates at the lower end of the panty portion without causing any discomfort to the wearer. The transition to a two-ply fabric in the panty portion of the undergarment as compared to the single ply fabric that comprises the leg portions results in a greater control ratio in the tummy and abdominal area without restricting the comfort of the wearer and without compromising the buttocks enhancing function that is the novelty of the central embodiment of the undergarment 10 and is further enhanced with the application of the front panel 10*b*. This utility design also allows for yarn consistency throughout the fabrication of the invention with only the gusset system 11*c* being fabricated with an alternate elastic yarn.

Therefore, the hosiery undergarment in accordance with the present invention, directly addresses the need for a hosiery type foundation garment with a fully integrated multipurpose buttocks enhancing, tummy shaping and tummy smoothing system that is comfortable to wear and virtually invisible when worn under outer garments of any styling. This favorable comparison to all prior art is achieved with a feathered edge contoured buttocks enhancing rear panel 10*a* with a concave inner section and a convex outer or posterior side that lifts the wearer's derriere and comfortably, as it is anchored with a highly elastic and two-way stretchable diamond shape gusset 11*c*, which is designed to maintain the contoured buttocks enhancing look regardless of the position and movement of the wearer. And, coupled with a two-ply tummy control panel 10*b* for a comfortable slimming of the wearer's abdominal region, two enhancing functions are achieved with one foundation garment. As such, the garment 10 can be worn as the only foundation garment required under any choice outer garment.

As a result of the detailed analysis and illustrative description of the preferred embodiments of the present invention, others skilled in the art representative of the instant invention will think of ways to develop and market hosiery garments and tights with alternative embodiments. Such attempts are expected and could be presented in the form of a pantyhose or other hosiery undergarment with internal hip pockets to accept buttocks enhancing devices or a tummy control panel formed from excessive cross stitching, or the use of heavy resistant fabric, which are not the preferred construction method of the present invention. Therefore, it must be understood that the instant invention is not in anyway to be limited to specific embodiments disclosed herein, but other embodiments and modifications for achieving the central intent are to be integral and within the present invention. Changes in construction method, component placement and arrangement, and fabric combinations can be achieved without significant departure from the scope and spirit of the present invention.

Therefore, following the description of the present invention, what is claimed as new and desire to secure by Letters Patent is:

1. A lower-body foundation garment comprising: a contoured to fit the female, buttocks enhancing panty portion, configured to lift and enhance a buttocks region of a wearer by providing an interior concave contour and an exterior convex contour foam pad laminated with spandex fabric, with a marquise diamond shape gusset, and which is connected to two leg portions fabricated from two seamless tubular single-ply of the same Spandex fabric with the leg portions terminating at a point above or below the garment wearer's knees.

2. The lower-body foundation garment of claim 1, wherein the two-ply panty portion of the garment has a contoured to fit the female buttocks enhancing panel sandwiched within a posterior portion of the garment panty portion, with a convex contoured side and a concave inside, feathered edge which transition smoothly with the spandex fabric that comprises the fabric of the garment.

3. The lower-body foundation garment of claim 1, wherein the two-ply panty portion comprises a first panty half that is woven to a first unit of the legs portions and, similarly, a second panty half that is woven and connected to a second unit of the legs portion with both panty halves being joined to each other along a front seam and a back structured seam of the garment.

4. The lower-body foundation garment of claim 3, wherein the foundation undergarment elongated panty portion is folded over the contoured buttocks enhancing portion of the garment at a midpoint where the single ply fabric meets a heavier weaved portion of the foundation garment to laminate a rear panel, thereto with the panty portion folded over fabric joined at a lower end of the panty portion.

5. The lower-body foundation garment of claim 4, wherein the folded over single ply fabric results in two-plies of fabric to comprise inner and outer plies of the panty portion of the foundation garment with a transition back to a single ply fabric at a top edge of the leg portions.

6. The lower-body foundation garment of claim 1, wherein the fabric used in the foundation garment construction is a stretch yarn of between 50 and 70 denier, and the tummy control function of the foundation garment is achieved with a doubling over of a single ply material to form a two-ply material for providing greater tummy slimming and control effect.

7. The lower-body foundation garment of claim 1, wherein the fabric used is formed of yarns of between 50 and 70 denier.

8. The lower-body foundation garment of claim 1, wherein the foundation garment finished bottom of its leg portions are configured to terminate at a point on the garment wearer's legs above the knees.

9. The lower-body foundation garment of claim 1, wherein the foundation garment finished bottom of its leg portions are configured to terminate at a location on its wearer's legs below the knees.

10. The lower-body undergarment of claim 1, wherein the foundation garment finished bottom of its leg portions are configured to terminate at a point at the end of the garment wearer's anatomical legs to include a sewn closure seam to cover the garment wearer's toes.

11. The lower-body foundation garment of claim 1, wherein the leg portions are comprised of a single ply woven elastic and stretchable fabric.

12. The lower-body foundation garment of claim 1, wherein the panty portion is partly comprised of two-ply fabric with each ply woven of elastic and stretchable fabric seamlessly extended from the single-ply fabric comprising the leg portions.

13. The lower-body foundation garment of claim 1, wherein the elastic and stretchable spandex yarn is more or less greater than a 60 denier.

14. The lower-body foundation garment of claim 1, wherein the elastic and stretchable spandex yarn is more or less about a 70 denier.

15. The lower-body foundation garment of claim 1, wherein the entire garment is made of a elastic and stretchable yarn.

16. The lower-body foundation garment of claim 1, wherein the two-ply fabric which comprises the diamond shape gusset is of a different elastic, two-way stretch and breathable material, when compared to the stretchable fabric comprising the structural fabrication of the foundation garment.

17. The lower-body foundation garment of claim 1, wherein the stretch yarn is nylon, polyester spandex fabric.

18. The lower-body foundation garment of claim 1, wherein the panty portion of the foundation garment includes an upper end waist opening, which is identified with a waistband configured to surround the waist of the wearer of the foundation garment.

19. The lower-body foundation garment of claim 1, wherein the elastic and two-way stretchable fabric of which the leg portions are comprised, are of the same fabric and dimension of yarn as that of the panty portion, and simply doubled in the garment portion identified as the panty portion to form two fabric layers for lamination of the contoured buttocks enhancing convex and concave rear panel of the panty portion, and to provide improved tummy control in an abdominal area of the wearer of the foundation garment.

* * * * *